US011448396B2

(12) United States Patent
Wu

(10) Patent No.: US 11,448,396 B2
(45) Date of Patent: Sep. 20, 2022

(54) TRANSFORMABLE WICK DEVICE AND CORRESPONDING COMBUSTION DEVICE

(71) Applicant: Pro-Iroda Industries, Inc., Taichung (TW)

(72) Inventor: Wei Cheng Wu, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 127 days.

(21) Appl. No.: 16/822,567

(22) Filed: Mar. 18, 2020

(65) Prior Publication Data

US 2020/0348020 A1 Nov. 5, 2020

(30) Foreign Application Priority Data

May 3, 2019 (TW) ..... 108115336

(51) Int. Cl.
*F23D 3/24* (2006.01)
*F23D 3/08* (2006.01)

(52) U.S. Cl.
CPC ..... *F23D 3/24* (2013.01); *F23D 3/08* (2013.01)

(58) Field of Classification Search
CPC ..... F23D 3/08; F23D 3/24; F23D 3/18; C11C 5/008
See application file for complete search history.

(56) References Cited

U.S. PATENT DOCUMENTS

RE2,108 E * 11/1865 Humiston ..... 425/444
987,433 A * 3/1911 Crawford ..... A01K 13/003 119/652
1,719,679 A * 7/1929 Muller-Thym ..... F21V 37/00 431/325
1,959,624 A * 5/1934 Hallquist ..... F23Q 13/00 431/327
2,029,994 A 2/1936 Fabel
2,210,290 A 8/1940 Heinsohn
2,310,019 A * 2/1943 Hamblet ..... C11C 5/006 431/126
2,392,529 A * 1/1946 Gottholm ..... B61L 1/20 246/486
2,531,565 A * 11/1950 Gottholm ..... B61L 1/20 24/601.3
2,611,254 A * 9/1952 Byrnes ..... C11C 5/006 431/126
3,215,385 A * 11/1965 Rockland ..... F16B 2/20 211/113
3,672,568 A * 6/1972 Foote ..... F24H 1/00 236/44 R
3,742,900 A * 7/1973 DeKavallas ..... C11C 5/025 118/712
4,569,656 A 2/1986 Shimizu et al.
(Continued)

FOREIGN PATENT DOCUMENTS

CN 103868062 A 6/2014
JP 57124618 A * 8/1982
(Continued)

*Primary Examiner* — Jorge A Pereiro

(74) *Attorney, Agent, or Firm* — Alan D. Kamrath; Karin L. Williams; Mayer & Williams PC

(57) ABSTRACT

A transformable wick device includes a plurality of bodies connected together. The plurality of bodies has flexible connections, and therefore positionable along a line of various types.

15 Claims, 5 Drawing Sheets

(56) References Cited

U.S. PATENT DOCUMENTS 5,235,919 A * 8/1993 Robuck ..... A01M 29/34 116/22 A
5,354,197 A * 10/1994 Barone ..... F23D 3/16 431/295
5,439,376 A * 8/1995 Kramer ..... C11C 5/006 431/295
5,860,725 A * 1/1999 Zer ..... F21V 33/0092 431/126
5,927,964 A * 7/1999 Fawcett ..... C11C 5/002 431/126
6,186,776 B1 * 2/2001 Myerchin ..... F23D 3/16 431/295
7,156,052 B2 * 1/2007 Maupin ..... A01K 13/003 119/602
8,028,661 B2 * 10/2011 Maupin ..... A01K 13/003 119/661
D705,459 S * 5/2014 Decker ..... D26/6
9,476,586 B2 * 10/2016 Chen ..... F23D 3/24
9,651,246 B2 * 5/2017 Chen ..... F23D 3/20
9,662,704 B2 * 5/2017 Winograd ..... B21F 27/12
10,337,730 B2 * 7/2019 Chen ..... F23D 3/08
10,458,648 B2 10/2019 Chen
10,690,338 B2 * 6/2020 Chen ..... F21V 37/0008
10,808,926 B2 * 10/2020 Chen ..... F23D 14/84
2001/0054299 A1 * 12/2001 White ..... A44C 3/008 63/23
2003/0019242 A1 * 1/2003 White ..... A44C 17/02 63/35
2004/0008509 A1 * 1/2004 Decker ..... A61L 9/037 362/159
2004/0009447 A1 * 1/2004 Decker ..... F23D 14/18 431/288
2005/0037307 A1 * 2/2005 Decker ..... F23D 3/24 431/320
2005/0082763 A1 * 4/2005 DeGennaro ..... A63F 9/18 273/430
2006/0172242 A1 * 8/2006 Collard ..... F23D 3/20 431/289
2011/0027736 A1 * 2/2011 Decker ..... F23D 3/16 431/289
2012/0202160 A1 * 8/2012 Ford ..... F23D 3/08 431/289
2012/0264069 A1 * 10/2012 Ramirez ..... C11C 5/006 431/295
2013/0330678 A1 * 12/2013 Chen ..... F21V 37/002 431/323
2014/0154636 A1 * 6/2014 Thompson ..... F23D 3/16 431/126
2014/0162202 A1 * 6/2014 Chen ..... F23D 3/08 431/323
2015/0030988 A1 * 1/2015 Chen ..... F23D 3/24 431/315
2015/0064635 A1 * 3/2015 Chen ..... F23D 3/08 431/325
2017/0042304 A1 * 2/2017 Hunter ..... A45D 8/12
2019/0069649 A1 * 3/2019 Qin ..... F21S 4/10

FOREIGN PATENT DOCUMENTS

JP S57131908 A 8/1982
JP S58142104 A 8/1983
JP 59046422 A * 3/1984 ..... C11C 5/008
TW M443831 U 12/2012

* cited by examiner

TRANSFORMABLE WICK DEVICE AND CORRESPONDING COMBUSTION DEVICE

BACKGROUND OF THE INVENTION

1. Field of the Invention

The present invention relates to a wick and, particularly, to a transformable wick device.

2. Description of the Related Art

TW Pat. No. M443831 discloses a metal wick which has meshes and is coiled about an axis. The metal wick has a first end and a second end on opposite ends. The metal wick has a plurality of loops disposed concentrically about the axis and spaced from one another, and a space between two adjacent loops is annular.

Generally, the shape and the size of the wick influence the appearance of the flame. The wick set forth in TW Pat. No. M443831 holds a generally pointed flame.

TW Pat. No. 1491839 discloses a wick of a combustion device. The wick is made of metal and has a meshed body. The wick includes a coiling portion, a folding portion and an enclosing portion. The coiling portion includes loops disposed concentrically about the axis. The folding portion extends along a first plane away from the coiling portion and then along a second plane towards the winding portion. The enclosing portion extends from the folding portion and surrounds the coiling portion and the folding portion.

The wick set forth in TW Pat. No. 1491839 holds a flame which is linear.

Nevertheless, consumers are no longer satisfied with the visual effects of the above-mentioned traditional types of flames and want a newer and stranger experience.

The present invention is, therefore, intended to obviate or at least alleviate the problems encountered in the prior art.

SUMMARY OF THE INVENTION

According to the present invention, a transformable wick device includes a plurality of bodies connected together. The plurality of bodies has flexible connections, and therefore positionable along a line of various types.

Further, a combustion device includes a fuel reservoir and a transformable wick device received by the fuel reservoir. The transformable wick device includes a plurality of bodies connected together. The plurality of bodies has flexible connections, and therefore positionable along a line of various types.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
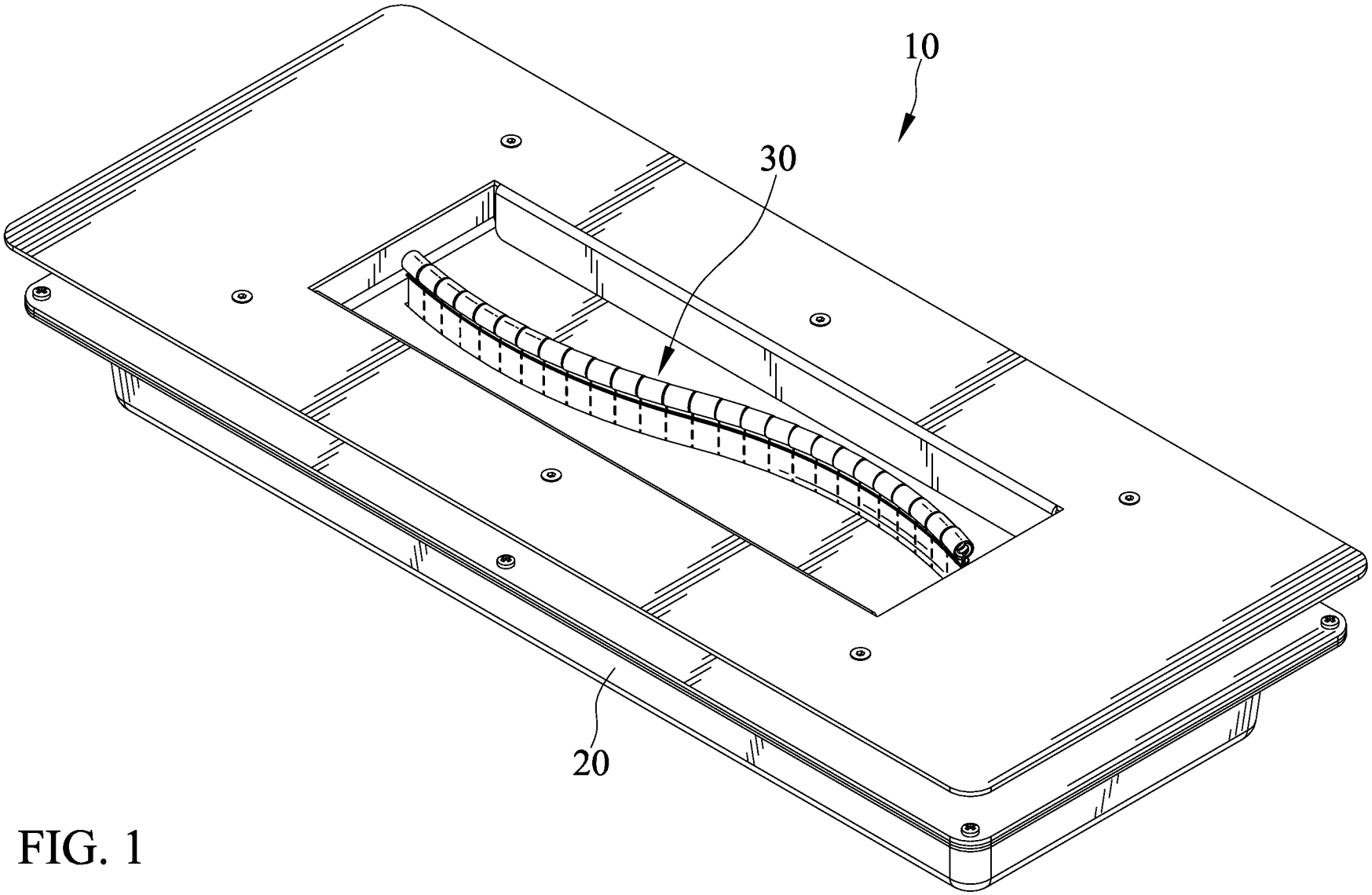
FIG. 1 is a perspective view of a combustion device in accordance with the present invention.
Figure 2:
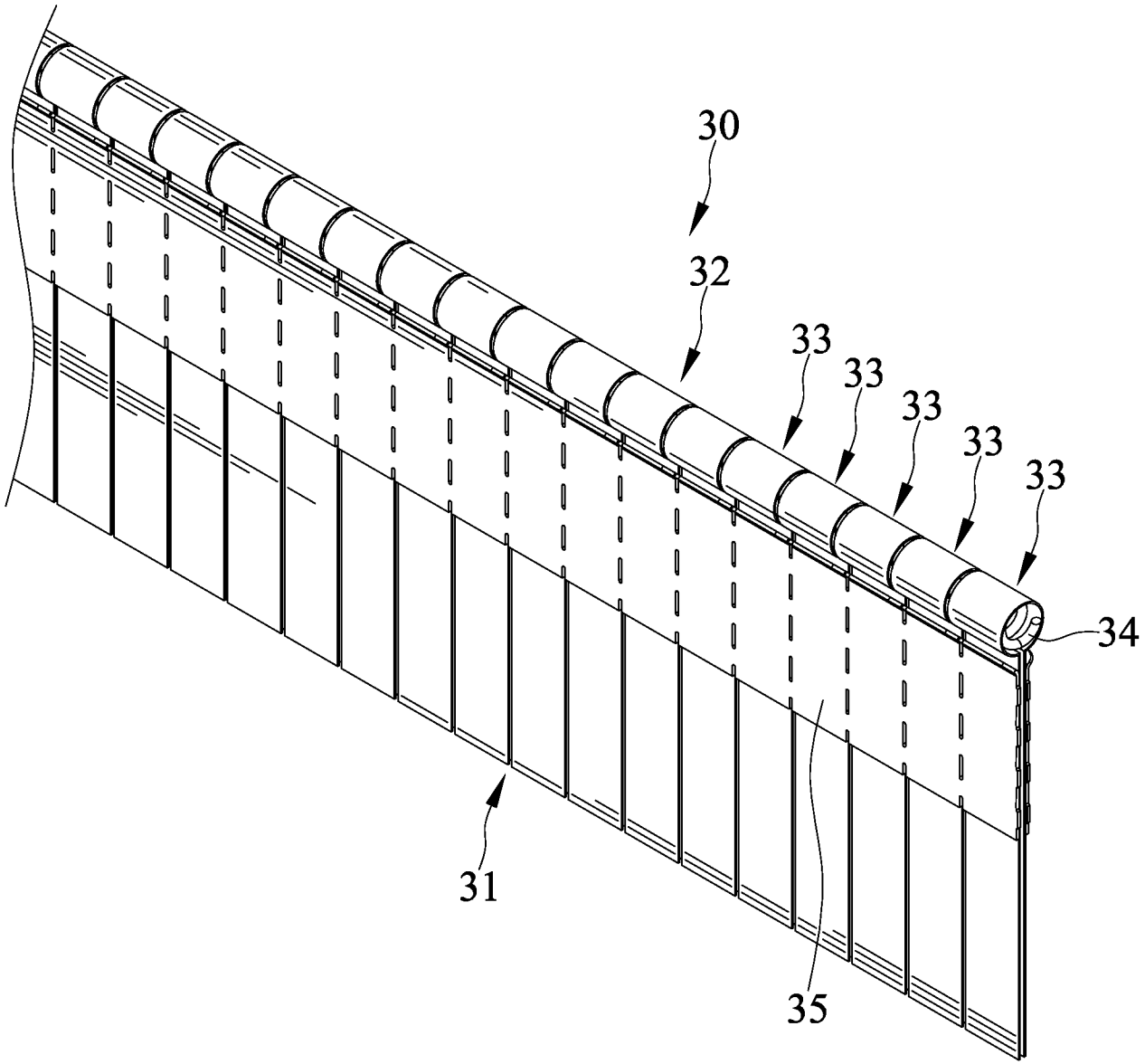
FIG. 2 is a perspective view of a first embodiment of a transformable wick device of the combustion device.
Figure 3:
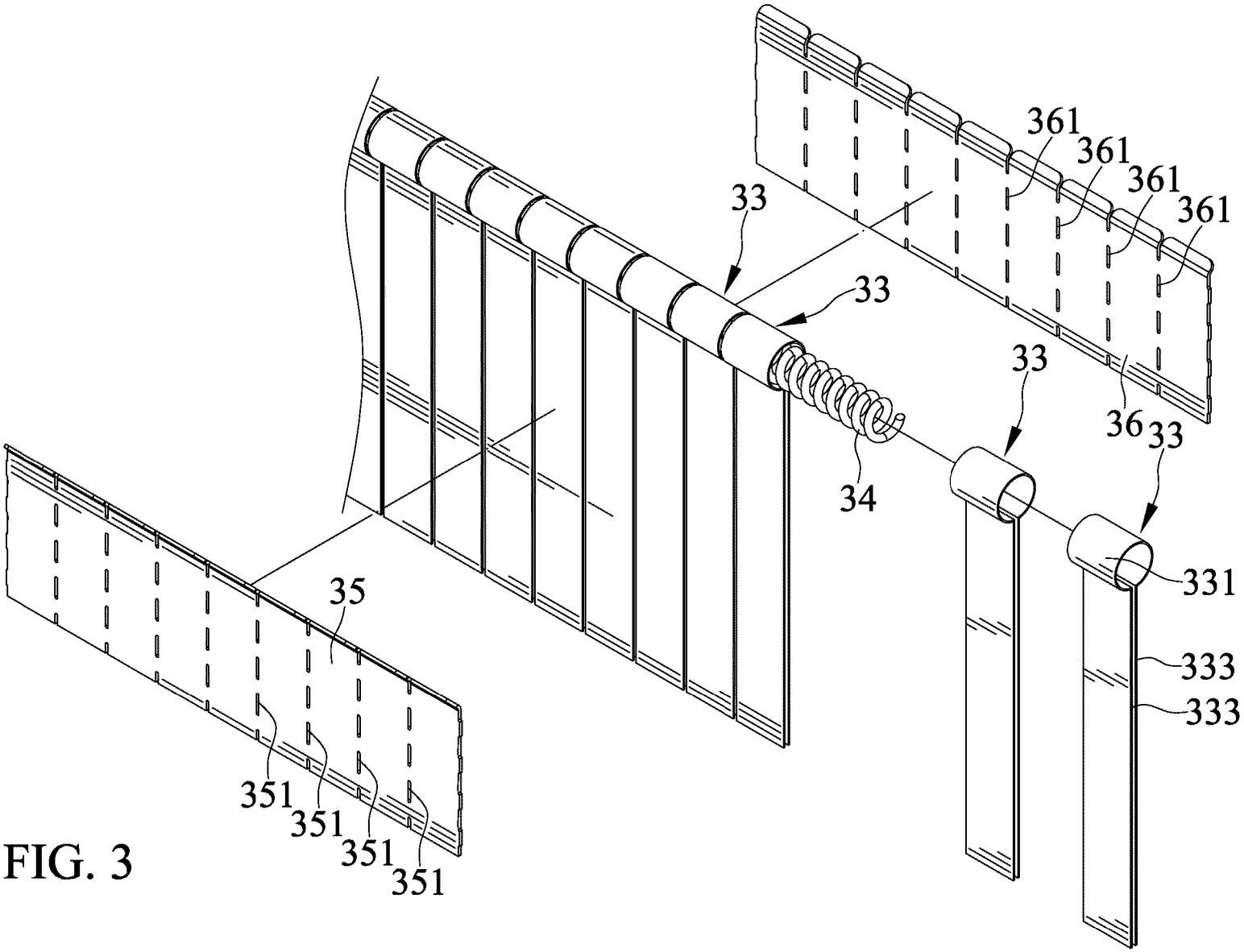
FIG. 3 is an exploded perspective view of the transformable wick device of FIG. 2.
Figure 4:
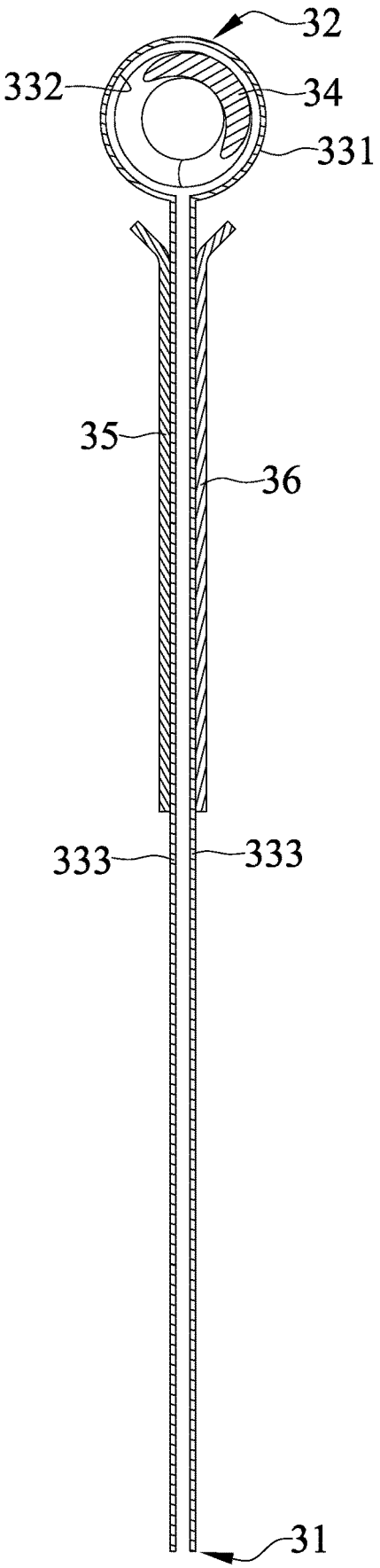
FIG. 4 is a cross-sectional view of the transformable wick device of FIG. 2.

A combustion device 10 includes a fuel reservoir 20 and a transformable wick device 30 received by the fuel reservoir 20.

The fuel reservoir 20 defines a space in which fuel is disposed.

The transformable wick device 30 has a plurality of bodies 33 connected together. The plurality of bodies 33 has flexible connections, and therefore positionable along a line of various types. The plurality of bodies 33 is made of fiber glass or metal.

Moreover, a connector 34 interconnects the plurality of bodies 33. The connector 34 interconnects portions 331 of the plurality of bodies 33. The portions 331 define holes 332 and the connector 34 is inserted in the holes 332. The connector 34 is flexible such that its shape is adapted to be transformed. When the connector 34 transforms shapes, the plurality of bodies 33 is arranged in a shape conforming to a shape of the connector 34. The connector 34 extends spirally Each of the plurality of bodies 33 has a bottom end 31 and a top end 32 and extends upwards from the bottom end 31 to the top end 32. When the transformable wick device 30 is lit, the plurality of bodies 33 includes the bottom ends 31 immersed in the fuel and the top ends 32 holding the flame.

Each of the plurality of bodies 33 includes the portion 331 and the top end 32 adjacent to each other. Each of the first portions 331 has two ends spaced from each other.

Each of the plurality of bodies 33 has a portion 333 adapted to be immersed in fuel to supply the fuel to a flame when the transformable wick device 30 is lit. Each of the plurality of bodies 33 includes the portions 331 and 333 adjacent to each other.

Each of the portions 333 has a first section which extends axially from one of two ends of the first portion 331 and a second section which extends axially from the other of two ends of the first portion 331.

A mold assembly which includes a mold 35 and a mold 36 cooperating to hold the plurality of bodies 33 in between. The molds 35 and 36 are made of metal. The molds 35 and 36 are disposed on the portions 333. The molds 35 and 36 partially cover the portions 333, The mold 35 is pliable and adapted to be bent through a plurality of crease lines 351 extending therein. The mold 36 is pliable and adapted to be bent through a plurality of crease lines 361 extending therein.

Figure 5:
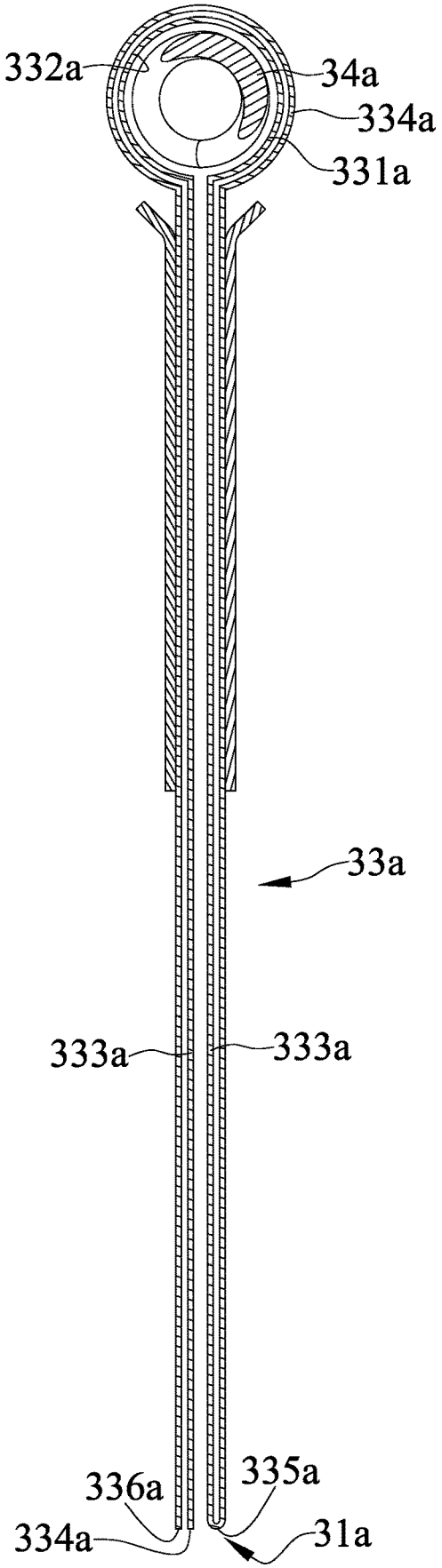
FIG. 5 is a cross-sectional view of a second embodiment of a transformable wick device of the present invention.

FIG. 5 show a tool transformable wick device in accordance with a second embodiment of the present invention, and the same numbers are used to correlate similar components of the first embodiment, but bearing a letter a. Similarly, a plurality of bodies 33*a* is connected together and has flexible connections. Each of the plurality of bodies 33*a* has a bottom end 31*a*. Each of the plurality of bodies 33*a* includes a portion 331*a* having two ends spaced from each other and a portion 333*a* which includes a first section extending axially from one of two ends of the portion 331*a* and a second section extending axially from the other of two ends of the portion 331*a*. When a connector 34*a* transforms shapes, the plurality of bodies 33*a* are arranged in a shape conforming to a shape of the connector 34*a*.

The second embodiment differentiates from the first embodiment in that the first section of the second portion 333*a* has a first length which extends axially from one of two ends of the first portion 331*a*, a bend 335*a* which extends from the first length, a second length which extends from the first length, a third length which extends from the second length and extends along the first length, a fourth length which extends from the third length and forms an annulus 334*a* extending along the first portion 331*a* from which the first section extends, and a fifth length which extends from the fourth length and extends along the second section of the second portion 333*a* and has a free end 336*a*.

In view of the foregoing, each of the transformable wick devices 30 includes a plurality of bodies 33 and 33*a* connected together. The plurality of bodies 33 and 33*a* has flexible connections, and therefore positionable along a line of various types. Further, when the connectors 34 and 34*a* transforms shapes, the plurality of bodies 33 and 33*a* are arranged in a shape conforming to a shape of the connectors 34 and 34*a*. Thus, the wick devices 30 are transformable and the shape of the flame changes in response to transformation of the wick devices 30.

The foregoing is merely illustrative of the principles of this invention and various modifications can be made by those skilled in the art without departing from the scope and spirit of the invention.

What is claimed is:

1. A transformable wick device comprising:

a plurality of bodies connected together by a connector inserted through the plurality of bodies and extending spirally along a longitudinal length thereof, such that the plurality of bodies has flexible connections and therefore positionable along a line of various types, wherein the connector is flexible such that its shape is adapted to be transformed, wherein when the connector transforms shapes, the plurality of bodies is configured to conform to a shape of the connector, wherein the plurality of bodies has first portions and the connector interconnects the first portions, wherein each of the first portions has two ends spaced from each other, wherein the plurality of bodies has second portions adapted to be immersed fuel, and wherein each of the second portions has a first section which extends axially from one of two ends of the first portion and a second section which extends axially from the other of two ends of the first portion, wherein the first section has a first length which extends axially from one of two ends of the first portion, a bend which extends from the first length, a second length which extends from the bend, a third length which extends from the second length and extends along the first length, a fourth length which extends from the third length and forms an annulus extending along the first portion from which the first section extends, and a fifth length which extends from the fourth length and extends along the second section of the second portion.

2. The transformable wick device as claimed in claim 1, wherein the first portions define holes, and wherein the connector is inserted in the holes.

3. The transformable wick device as claimed in claim 1, wherein each of the first portions has two ends spaced from each other, wherein the plurality of bodies has second portions adapted to be immersed in fuel, and wherein each of the second portions has a first section which extends axially from one of two ends of the first portion and a second section which extends axially from the other of two ends of the first portion.

4. The transformable wick device as claimed in claim 1, wherein the plurality of bodies is made of fiber glass.

5. The transformable wick device as claimed in claim 1, wherein the plurality of bodies is made of metal.

6. A transformable wick device comprising:

a plurality of bodies connected together by a connector inserted through the plurality of bodies and extending spirally along a longitudinal length thereof, such that the plurality of bodies has flexible connections and therefore positionable along a line of various types, wherein the connector is flexible such that its shape is adapted to be transformed, wherein when the connector transforms shapes, the plurality of bodies is configured to conform to a shape of the connector, wherein the plurality of bodies has first portions and the connector interconnects the first portions, wherein each of the first portions has two ends spaced from each other, wherein the plurality of bodies has second portions adapted to be immersed fuel, and wherein each of the second portions has a first section which extends axially from one of two ends of the first portion and a second section which extends axially from the other of two ends of the first portion; and a mold assembly which includes a first mold and a second mold cooperating to hold the plurality of bodies in between, wherein the first and the second molds are disposed on the second portions.

7. The transformable wick device as claimed in claim 6, wherein the first and the second molds partially cover the second portions.

8. The transformable wick device as claimed in claim 6, wherein the first mold is pliable and adapted to be bent through a plurality of first crease lines extending therein, and wherein the second mold is pliable and adapted to be bent through a plurality of second crease lines extending therein.

9. The transformable wick device as claimed in claim 6, wherein the first and the second molds are made of metal.

10. A combustion device comprising:

a fuel reservoir and a transformable wick device received by the fuel reservoir, wherein the transformable wick device has a plurality of bodies connected together by a connector inserted through the plurality of bodies such that the plurality of bodies has flexible connections and is positionable along a line of various types, wherein the connector extends spirally along a longitudinal length thereof, wherein each of the first portions has two ends spaced from each other, wherein the plurality of bodies has second portions adapted to be immersed fuel, and wherein each of the second portions has a first section which extends axially from one of two ends of the first portion and a second section which extends axially from the other of two ends of the first portion;

a mold assembly which includes a first mold and a second mold cooperating to hold the plurality of bodies in between, and wherein the first and the second molds are disposed on the second portion of each of the plurality of bodies.

11. The combustion device as claimed in claim 10, wherein the transformable wick device has a top end disposed outside the fuel reservoir.

12. The combustion device as claimed in claim 10 further comprising a connector interconnecting the plurality of bodies, wherein the plurality of bodies has first portions and the connector interconnects the first portions.

13. The combustion device as claimed in claim 12, wherein the first portions define holes, and wherein the connector is inserted in the holes.

14. The combustion device as claimed in claim 10, wherein each of the first portions has two ends spaced from each other, wherein the plurality of bodies has second portions adapted to be immersed in fuel, and wherein each of the second portions has a first section which extends axially from one of two ends of the first portion and a second section which extends axially from the other of two ends of the first portion.

15. The combustion device as claimed in claim 10, wherein the first mold is pliable and adapted to be bent through a plurality of first crease lines extending therein, and wherein the second mold is pliable and adapted to be bent through a plurality of second crease lines extending therein.

* * * * *